US005482094A

United States Patent [19]

Mitchell

[11] Patent Number: 5,482,094

[45] Date of Patent: Jan. 9, 1996

[54] FUEL DISPENSING NOZZLE WITH DELAYED SHUT-OFF

[75] Inventor: Thomas O. Mitchell, St. Louis County, Mo.

[73] Assignee: Husky Corporation, Pacific, Mo.

[21] Appl. No.: 283,609

[22] Filed: Aug. 1, 1994

[51] Int. Cl.[6] ..... B67D 5/377

[52] U.S. Cl. ..... 141/209; 141/206

[58] Field of Search ..... 141/206, 209–211, 141/214, 215, 217, 218

[56] References Cited

U.S. PATENT DOCUMENTS

| | | | |
|---|---|---|---|
| 3,077,212 | 2/1963 | Hearn | 141/209 |
| 3,216,465 | 11/1965 | Boone et al. | 141/209 |
| 4,497,350 | 2/1985 | Guertin | 141/206 |
| 5,007,468 | 4/1991 | Wilder et al. | 141/209 |
| 5,307,848 | 5/1994 | Murray | 141/206 X |

*Primary Examiner*—J. Casimer Jacyna
*Attorney, Agent, or Firm*—Paul M. Denk

[57] ABSTRACT

A fuel dispensing nozzle has a body in which a fuel passage is formed, a spout attached to the body, a poppet valve contained within the nozzle body, for controlling the flow of fuel through the nozzle; a hand operated lever actuates the poppet valve, and the nozzle includes an automatic shut-off mechanism to provide shut-off of the nozzle, when the fuel tank is filled. The automatic shut-off mechanism includes a plunger, a latch pin disposed for vertical movement therein, with the latch pin being embraced by a diaphragm support, of the automatic shut-off mechanism, to provide a lost motion gap which allows the diaphragm to slightly shift, during initiation and dispensing of fuel, and prevent premature shut-off; the latch pin includes an annular upwardly extending collar, that is capable of connecting with a surrounding shoulder formed of the diaphragm support. There is also provided a sleeve-like collar mounted upon the latch pin, to separate the upper end of the plunger from the lower shoulder of the diaphragm support.

1 Claim, 2 Drawing Sheets

FUEL DISPENSING NOZZLE WITH DELAYED SHUT-OFF

BACKGROUND OF THE INVENTION

This invention relates to fuel dispensing nozzles of the type used to dispense gasoline into automobiles and the like, and more particularly to an improvement in the shut-off apparatus that prevents nozzle failure when the nozzle is quickly activated and prevents premature shut off due to slight changes in the pressure differential that activates the nozzle shut-off mechanism.

As is well known, gasoline dispensing nozzles of the type found at most service stations include a spout which is inserted into the inlet of the filler pipe of an automobile's fuel tank. Generally the nozzle has a fluid flow path to allow fuel to flow through the nozzle and out through the spout. Recently, in response to environmental concerns, conventional nozzles are designed with a vapor flow path to capture fuel vapors and return them to the fuel dispensing system to avoid release of the vapors into ambient air. Conventional nozzles incorporate a popper valve apparatus in the fluid flow path to control the main flow of fuel through the nozzle. This valve apparatus is activated to open when the customer lifts the handle or lever to begin dispensing fuel. The lever abuts a poppet stem and pushes the poppet valve off its seat thereby opening the fuel flow pathway.

Generally, conventional nozzles have an automatic shut off assembly within the nozzle to close the poppet valve in response to a change in pressure, for example, when excessive pressure is encountered, or when the fuel level in the vehicle gas tank reaches a full condition. A conventional automatic shut off assembly contains a plunger that is retained in an up, or nozzle opened position within the nozzle, when the lever is activated to open the poppet valve to permit fluid fuel flow through the nozzle. However, when the plunger drops to a down nozzle closing position, it functions as as an alternate pivot point, relieving lever pressure on the poppet valve, thus allowing the valve to close and immediately shut off the flow of fuel through the fuel flow pathway.

The plunger is moved to the up or nozzle opening position by a spring means, and connects at its bottom end to the front of the lever that urges when activated the poppet valve to open. The plunger has a plurality of retainer balls seated in clearance slots at an upper end that are outwardly biased by an enlargement on a latch pin which seats within the upper end of the plunger. The outwardly biased retainer balls engage a latch ring and thus hold the plunger in the up position. The latch pin is connected to and moves with a superposed diaphragm housed in a vacuum forming chamber above the plunger. The vacuum chamber is in pressure communication with a venturi located in the spout. A change of pressure at the venturi creates a low pressure or vacuum in the chamber thus drawing the diaphragm upward, when the vented end of the spout is blocked due to dispensing fuel reaching a full capacity in the tank. The attached latch pin lifts from the plunger upwardly allowing the retaining balls to recede into their seats within the plunger. The plunger then slips below the latch ring and drops into its secondary or lever dropping position thus pushing the lever away from a poppet valve stem and allowing the poppet valve to close, immediately shutting off fluid flow.

The conventional automatic shut-off assemblies have several drawbacks. Due to tolerances in the various parts of the diaphragm assembly, the associated latch pin and its plunger, and also due to the positioning of the latch ring, there is some travel by the plunger before the retaining balls engage the latch ring. This movement or travel is referred to as "loss motion". Moreover, the diaphragm, with the conventional latch pin attached thereto, must move downward upon activation of the lever so that the latch pin seats within the plunger to effectively bias the retaining balls to engage the latch ring and hold the plunger in the lifted and nozzle opening position. The vacuum chamber above the diaphragm generally has two small ports to vent through. In order for the diaphragm, and the associated latch pin, to move downward, air has to enter the chamber through the small port at the tip of the nozzle spout to equalize the pressure and allow the diaphragm to also equalize. When a customer quickly activates the nozzle lever, the plunger is jarred and the latch mechanism retaining balls are held above the level of the latch ring and then descends slightly to the point where the retaining balls can engage the latch ring. This slight downward movement is the "loss motion". The plunger, however, moves downward toward the latch ring faster than the diaphragm can move, due to the slow displacement of air in the vacuum chamber, and the latch pin, connected to the diaphragm, does not always engage the plunger to bias the retaining balls outward. Therefore, sometimes the plunger slips below the latch ring to its closed position thereby preventing the poppet valve from opening. This can be frustrating to the customer who must actuate the lever several times and eventually actuate the lever more slowly so that the diaphragm, and the associated latch pin, has sufficient time to set up and slightly shift downward and engage the plunger to hold the plunger in the up or nozzle opening position.

Furthermore, since the latch pin moves directly with the diaphragm, any change in pressure in the vacuum chamber above the diaphragm will cause the diaphragm to rise, drawing the latch pin away from the retainer balls. The balls recede into their seats in the plunger and the plunger falls below the latch ring, shutting off fluid flow. Although this is the functional objective of the automatic shut-off assembly when the tank is full, it can be frustrating if the shut-off occurs prematurely. For example, if fluid splashes up from the tank onto the vent ports located on the spout, a slight pressure differential can be created in the associated vacuum chamber and the diaphragm prematurely moves slightly upward. The associated latch pin will also be pulled up and the plunger will drop, undesirably shutting off fluid flow.

It would be advantageous, therefore, to have a latch pin operatively associated with the diaphragm that will not immediately move up with the diaphragm as the diaphragm moves upward in response to slight variations in the vacuum pressure, and provide some degree of play in the operations of these components, thereby creating a slight lag between the movement of the diaphragm and the movement of the latch pin. Very slight changes in pressure in the chamber above the diaphragm in response to splashing, for example, would not result in premature shut-off of fluid flow. However, normal vacuum changes due to a full gas tank will cause the diaphragm to effectively pull the latch pin out of its seat thereby causing the plunger to drop and thereby properly shut off fluid flow. Furthermore, it would be advantageous to have a latch pin operatively associated with the diaphragm that can move to some degree downwardly faster than the associated diaphragm so that the latch pin can move down with the plunger's loss motion and seat in the plunger as the balls effectively engage the latch ring to properly hold the plunger in the up position even though the diaphragm lags behind in its downward movement.

SUMMARY OF THE INVENTION

It is a principal object of the present invention to provide a fuel dispensing nozzle having an automatic shut-off apparatus that shuts off fluid flow in response to a change in pressure resulting from a full fuel tank but does not prematurely shut off the flow as a result of splashing of fuel on the air intake port generally located at the tip off the nozzle spout.

Another object off the present invention is to provide a fuel dispensing nozzle that has an automatic shut off apparatus comprised of a diaphragm assembly, a latch pin, and plunger wherein the latch pin has some degree off free and independent movement with respect to the diaphragm assembly so that the latch pin can properly seat in the plunger and bias the associated retaining balls outwardly independent of the initial shifting movement of the diaphragm assembly.

Yet another object of the present invention is provide a fuel dispensing nozzle that includes an automatic shut-off apparatus wherein the difference in the rate of movement between the diaphragm assembly and its latch pin does not result in premature nozzle shut off or failure to start dispensing when a customer quickly activates the nozzle dispensing lever.

Yet another object of the invention is to provide a fuel dispensing nozzle that includes an automatic shut-off apparatus wherein the loss motion that results from tolerances in the apparatus parts is utilized to prevent premature shut-off of the fluid flow that result from slight movements of the diaphragm in response to slight changes in vacuum pressure.

In accordance with the invention generally stated, a fuel dispensing nozzle is provided having a body in which a fuel passage is formed, a spout assembly attached forwardly of the body in fluid communication therewith to accommodate the flow of fuel from the body through the spout and into the tank, and a lever actuated popper valve assembly situated within the fluid flow path to control the flow of fluid through the nozzle and its flow path. The nozzle has an automatic shut off apparatus to close the poppet valve assembly to halt the flow of fuel particularly in response to changes in pressure sensed by a diaphragm assembly, as when vent ports located at the outlet of the spout are blocked. The shut-off apparatus contains a plunger that can be positioned in an up or open position to sustain normal fluid flow. The plunger has a down or closed position in which it biases the lever away from the poppet valve and stem assembly allowing the poppet valve to close thus shutting off fluid flow. The plunger has a plurality of retention balls seated proximate an upper end. The balls are biased outwardly by an enlarged portion of the latch pin so that the balls engage a latch ring to hold the plunger in its upward and open position. The latch pin is operatively associated with an upwardly disposed diaphragm assembly situated in a vacuum chamber above the latching assembly. There is loss motion gap formed between the latch pin and the diaphragm assembly. When the lever is activated, the plunger is pulled downwardly until the retainer balls are sustained above the latch ring. The plunger abruptly descends until the retainer balls engage the latch ring. The latch pin descends independent of the diaphragm assembly so that the latch pin is maintained in the plunger and biases the balls outwardly as the plunger descends through the loss motion gap. The diaphragm assembly lags behind the latch pin in any descending movement it encounters and eventually comes to rest at the top of the plunger. Obviously, the diaphragm assembly is responsive to changes in pressure in the fuel tank and primarily when the fuel tank becomes full. A vacuum formed in the chamber above the diaphragm assembly, caused by the nozzle venturi, draws the diaphragm assembly upwardly. Because of the presence of a loss motion gap between the diaphragm assembly and the latch pin, there is a slight delay in upward movement of the latch pin once the diaphragm assembly begins its upward movement. This slight upward movement of the diaphragm assembly will not result in latch pin movement thus preventing premature shut off of the nozzle due to slight pressure changes.

DESCRIPTION OF THE PREFERRED EMBODIMENT

Figure 1:
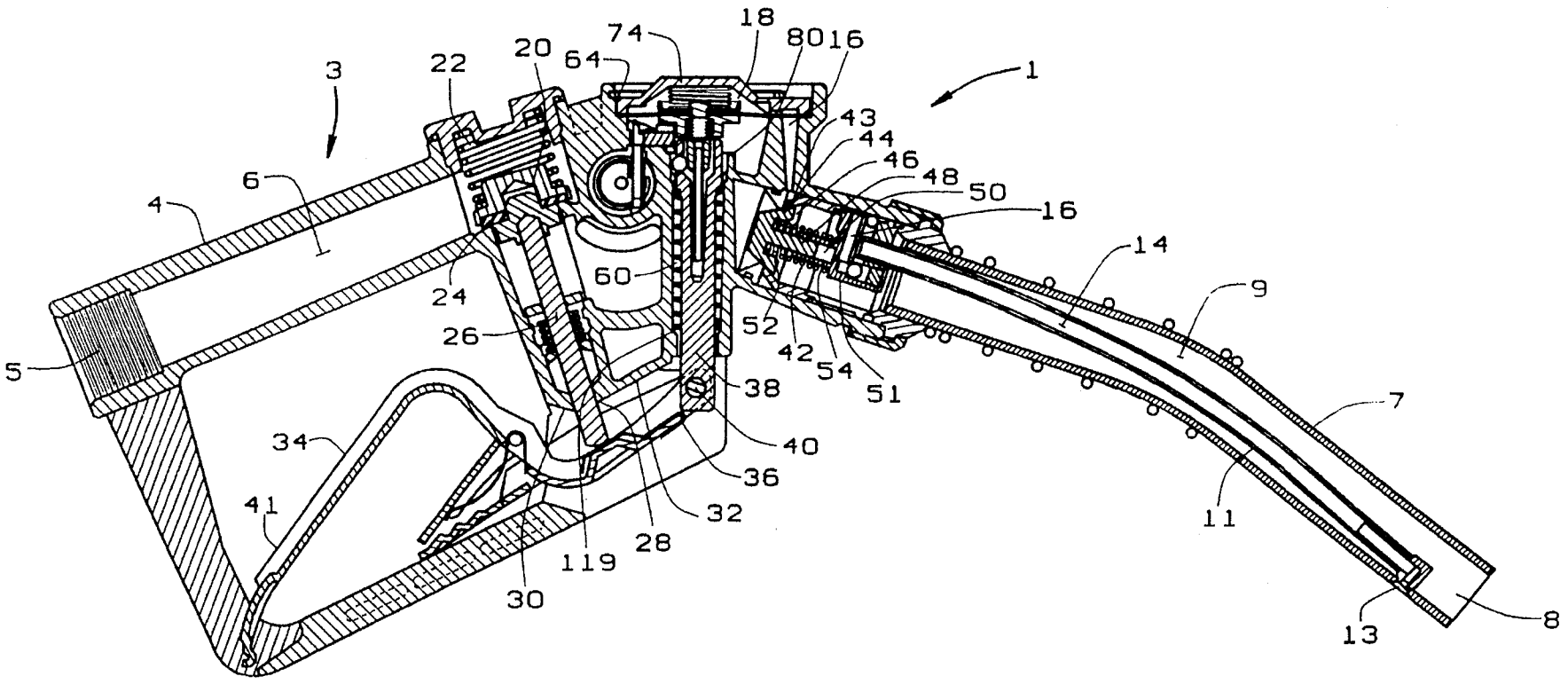
FIG. 1 is a cross sectional view of a fuel dispensing nozzle incorporating the improved automatic shut-off assembly of the present invention.

A fuel dispensing nozzle employing the improved automatic shut-off mechanism of the present invention is indicated generally in the drawings by reference numeral 1. Nozzle 1 has a body portion 3. Body 3 has a handle section 4 and an internally threaded inlet 5 for the attachment of nozzle 1 to a conventional fuel flow hose. Body 3 has a fuel flow pathway 6 formed therethrough. A spout 7 is attached forwardly to the body 3. Spout 7 is a generally elongated curved tubular element having an out-flow opening 8 which is insertable into a fuel tank, container or the like, wherein fuel is to dispensed. Spout 7 has an internal flow path 9 in fluid connection with pathway 6. A vent tube 11 is located within pathway 9. A first end of tube 11 is in fluid communication with a vent opening 13 adjacent opening 8. Vent tube 11 has an internal bore 14 in fluid connection with a vacuum pathway 16 in body 3 which is in communication with a vacuum chamber 18, as will be further described below. Blockage by fuel at opening 13 results in a change of pressure in chamber 18.

A poppet valve 20 is situated in flow path 6 to control the flow of fluid through path 6. Valve 20 is biased by a spring 22 into a sealing engagement with valve seat 24. Valve 20 is secured to the upper end of a valve stem 26. Valve stem 26 extends downwardly through the body. A lower end of stem 26 projects through an opening 28 in the base 30 of body section 32. A hand operated lever 34 has one end 36, its fulcrum, connected to the lower end of a plunger 38 by, for example, a pivot pin 40. The outer end 41 of the lever is grasped by the hand of the user and, when squeezed, lever 34 engages the bottom of pin 26, which functions somewhat as a pivot point. Lever 34 forces valve stem 26 upwardly. This moves valve 20 off of valve seat 24 thereby opening the valve and permitting fuel flow through the nozzle.

Adjacent spout 7, in the flow path 9 formed in the spout, is a venturi section 42. A spring loaded venturi valve 43 is positioned in the venturi, on the downstream side thereof, so as to control and regulate fuel flow into path 9. Check valve 43 has a valve body 44, situated in a venturi chamber 45, which is frusto-conically shaped and fits in a flow restriction formed by the venturi section, forming a suction port 45*a*. Extending from the underside 46 of the valve body is a valve stem 48. This stem is slidingly received in a cylindrically shaped valve guide 50 which projects inwardly into path 9 from an interior wall portion 51 of the forward end of the nozzle body. An annular groove 52 is formed on the underside 46 of the valve body, adjacent stem 48, and extends upwardly into the valve body. The width of this groove is sufficient for a spring 54 to both fit into the groove and seat against its base thereof. Spring 54 also seats against the base of guide 50. When valve 20 is opened, the rush of fuel through the nozzle body and spout unseats check valve 43 so fuel can flow through the venturi section.

Figure 2:
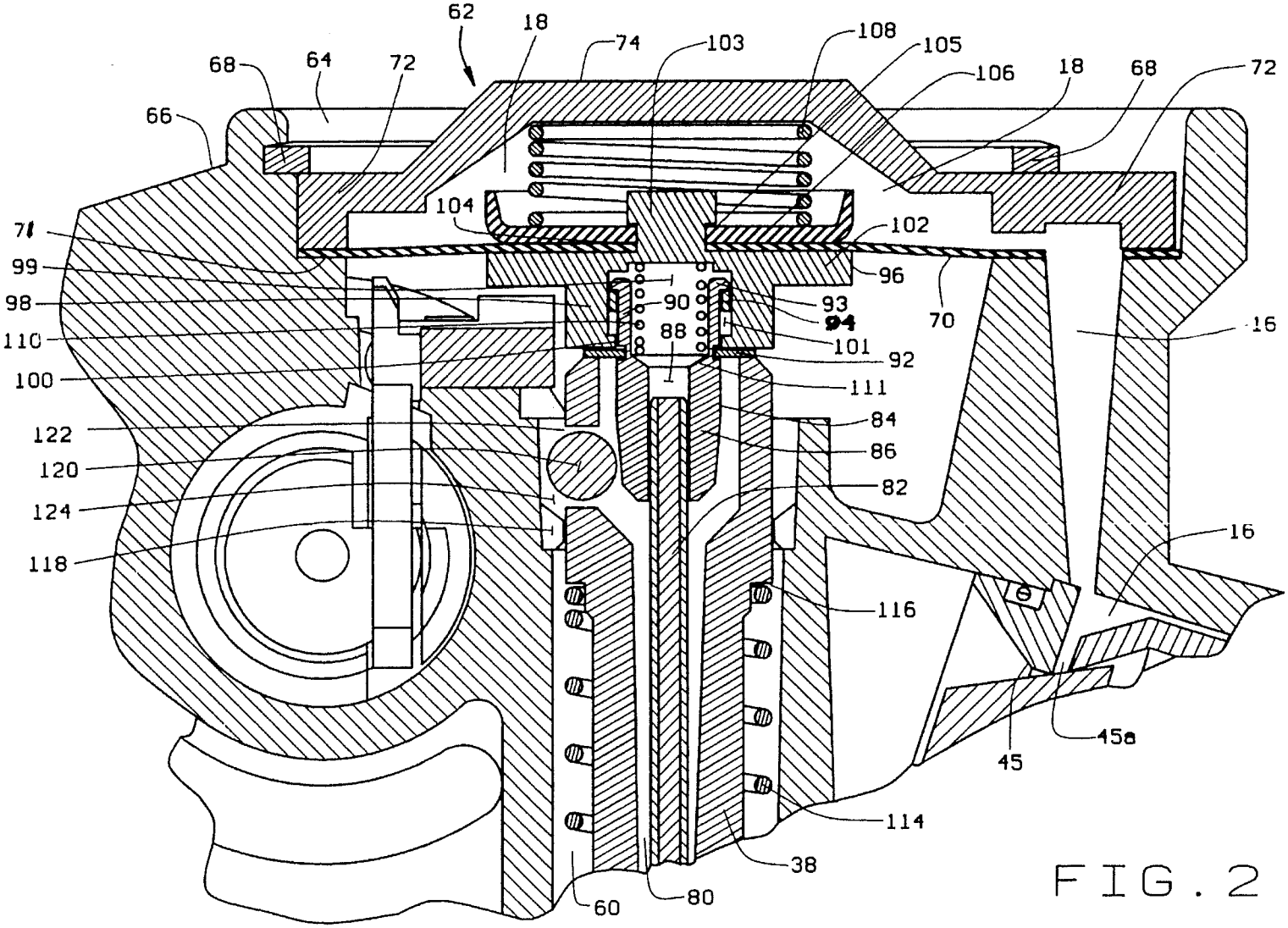
FIG. 2 is an enlarged, partial cross section view of the nozzle illustrating the improved shut-off assembly of the present invention as located in the region of its diaphragm assembly.

The improved shut off apparatus of the present invention, as best illustrated in FIG. 2, will now be described in greater detail. When the tank (not shown) is substantially full it is desirable to terminate further fuel flow through the nozzle. For this purpose, plunger 38 extends upwardly through a circular cavity 60 integrally formed in body 3. The lower end of plunger 38 is pivotally attached to the front end of lever 34. The upper end of the plunger is operatively associated with a diaphragm assembly shown generally at 62, which contains a diaphragm and diaphragm support as described in detail hereinafter. An opening 64 is formed in an upper face 66 of the nozzle body (FIG. 1) and a circumferential shoulder 68 extends thereabout. An outer edge of a diaphragm cap 74 is captured between shoulder 68 and the base 71 of the nozzle body. The diaphragm 70 at its ends is captured between the cap 72 and the base 71. The diaphragm 70 and cap 74 together define a vacuum chamber 18. One end of passage 16 opens into the chamber 18, as stated above.

Plunger 38 has a bore 80 extending from its upper end thereof and partially along its length. Fitting into bore 80 is a latch pin stem 82. Fixed adjacent to the upper end of the stem is the latch pin 84. Latch pin 84 has a generally tubular body section 86 having a lower exterior tapering portion, and defining an interior bore 88. There is an integral radial collar 90 on the top of body section 86 disposed to contact and move with a top annular surface 92 of plunger 38 when latch pin 84 is seated within plunger 38, as will be described below. Above collar 90 is an integral flange section 93 having a depending annular sleeve 94. Above latch pin 84 is a diaphragm support 96. Support 96 has an annular body 98 defining an inner bore 99. An integral, inner annular shoulder 100 is formed on the bottom of body 98 and projects into bore 99. A loss motion gap 101 is defined by shoulder 100 and sleeve 94.

A first backing plate 102 is integrally formed on the top of body 98. A mounting stud 103 extends upwardly from backing plate 102. Mounting stud 103 extends through a hole 104 in diaphragm 70 and through a hole 105 formed centrally in a second backing plate 106. The stud 103 may threadedly engage to the plate 102 to provide for its engagement through the diaphragm and the plate 106. Backing plate 106 also acts a seat for bias spring 108, the other end of which seats against the upper inner face of cap 74. A latch pin bias spring 110 seats within bore 99 and engages the annular shoulder 111 formed at the internal juncture of sections 86 and 93 of the latch pin. Bias spring 110 urges latch pin 84 downwardly.

A spring 114 seats against shoulder 116 and a lower shoulder 119 (FIG. 1) formed in the bottom wall of cavity 60 to urge plunger 38 upward. Fitting between the plunger 38 and the side wall of cavity 60, at a point immediately above shoulder 116, is a latch ring 118. The upper surface of the latch ring 118 is an annular formed shoulder in shape. A plurality of balls 120, usually three in number, are placed equidistance about the circumference of the upper end of plunger 38. Balls 120 are seated in ball seats or positioning slots 122 formed in the upper end of plunger 38.

When lever 34 is grasped by the user of the nozzle, plunger 38 is held in place with respect to the latch pin and diaphragm by these balls 120. This is because balls 120 are pushed outwardly from slots 122 by the peripheral surface of latch pin 84 so that the balls 120 engage latch ring 118 and hold the plunger in an up or open or fuel dispensing position. When lever 34 is lifted to attain fuel dispensing, plunger 38 tries to move down so the balls 120 position above the latch ring 118, and usually keeps the plunger in place. A second loss motion gap 124 being eliminated between balls 120 and latch ring 118 before plunger 38 descends sufficiently to allow balls 120 to engage the latch ring. However due to first loss motion gap 101, latch pin 84 also descends slightly with the plunger 38 thus allowing latch pin 84 to bias the balls outwardly into their plunger retention position. This allows plunger 38 to remain in the up or open position even if the user squeezes the lever rapidly.

In prior art nozzles, the latch pin is connected directly to and moves in tandem with the diaphragm. Prior art designs do not include a loss motion gap of the type as indicated by numeral 101 in the present invention. Their latch pin is connected to, and moves downward along with, the diaphragm. Therefore, when the user squeezes the lever quickly, the plunger moves immediately downwardly and there is no outward biasing of the balls by the latch pin since the latch pin moves simultaneously downward with the diaphragm. In prior devices the diaphragm moves more slowly than the plunger due to the fact that there is generally slow equalization of pressure above the diaphragm. The plunger thus falls below the latch ring by the downward pressure exerted on the lever, moving the lever away from its pivot point and away from the valve stem. The poppet valve will not open, and thus there is no flow through the nozzle.

However, with the present invention, as the stem travels the lost motion gap 101, and as balls 120 travel through the second gap 124, latch pin 84 moves downwardly under the force of spring 110 within cavity 80 and outwardly biases balls 120 so that the balls engage latch ring 118. This prevents an untimely shut-off of the nozzle. The diaphragm assembly 62, comprised of diaphragm 70, as connected to the diaphragm support 96, can slowly and independently move downwardly as the pressure above the diaphragm equalizes. Diaphragm 70 and the associated diaphragm support 96 move downwardly until shoulder 100 abuts collar 92. But, the nozzle is still prevented from shutting off, and eventually the gap 101 reforms, as the various pressures allow these components to reshift back to their normal positions.

As noted, air passage 16 is formed internally of body 3 and is in communication with vent tube 11. When the nozzle is being used to pump fuel, the fuel flowing past venturi valve 44 creates a vacuum in passage 16, through ports 45*a*. The ports 45*a* and passage 16 communicate with passage 14 in tube 11 and thus with opening 13. Air flowing into opening 13 at spout 7 is directed through tube 11, passage 16, and into chamber 18. Since under this condition chamber 18 is exposed to substantially atmospheric pressure, diaphragm 70 and support 96 are maintained in a down position by the spring 108. Spring 110 maintains latch pin 84 in a fully extended position. This in turn keeps poppet valve 20 open via the lever mechanism as previously explained. When spout 7 is inserted into a fuel tank (not shown) and as the tank fills, the level of fuel in the tank rises, eventually reaching opening 13. Restriction of opening 13 causes an increase in the generation of vacuum pressure in chamber 18. When the vacuum becomes sufficiently strong, the vacuum force overcomes the effect of spring 108 and the diaphragm 70 and diaphragm support 96 rises. Spring 110 continues to bias latch pin 84 in place within cavity 80. Diaphragm support 96 rises independently of the latch pin until shoulder 100 engages sleeve 94. Diaphragm support 96 then lifts latch pin 84 upward, allowing balls 120 to recede into seats 122, due to the narrowing taper of the body section 86. Plunger 38 then passes and falls below latch ring 118 to bias lever 34 downwardly from pivot point 40 thus providing clearance for the valve stem 26 and allowing poppet valve 20 to close, shutting off flow. When the user is finished delivering fuel, lever 34 is released and spring 114 urges plunger 38 upwardly. The force of this spring is enough to overcome the combined forces of springs 108 and 110. This allows the balls 120 to rise upwardly past latch ring 118 with latch pin 84 fully extended into plunger 38 for storage of the nozzles during nonuse.

Because of the construction of the diaphragm support 96 and the latch pin 84 creates a first loss motion gap 101, a small change in pressure in chamber 18, for example due to splashing of fuel on opening 13, will not cause premature nozzle shut-off. Latch pin 84 will not immediately be drawn out of plunger 38 since the diaphragm support 96 must move upwardly a predetermined increment, at least the distance of loss motion gap 101, before the diaphragm support 96 engages and pulls upwardly the latch pin. Therefore, diaphragm 70, as well as the associated diaphragm support 96, can move upwardly a small increment, and undertake some motion, without dislodging latch pin 84. Premature nozzle failure due to splashing of fuel on opening 13 is avoided. However, when the diaphragm, and associated support, rise a sufficient amount to allow shoulder 100 to engage lip 94, latch pin 84 will be withdrawn upwardly in cavity 80, allowing the poppet to close and stopping flow through the nozzle. This usually occurs only when the tank is full and opening 13 is obstructed for a sufficient amount of time.

In view of the foregoing it will be seen that the several objects of the invention are achieved and other advantageous results are obtained.

As various changes could be made in the above construction without departing from the scope of the invention, it is intended that all matter contained in the above description or shown in the accompanying drawings be interpreted as illustrative and not in a limiting sense.

Having thus described the invention what is claimed and desired to be secured by letters of patent is:

1. A fuel dispensing nozzle comprising, a nozzle body with a fuel passage formed therethrough, a spout assembly attached to said nozzle body and in fluid communication therewith, a poppet valve interposed in said fluid passage within said nozzle body to control fuel flow through said nozzle, a hand operated lever provided upon the nozzle body to actuate said poppet valve, and an automatic shut-off means responsive to pressure to effect the closing of said poppet valve, said automatic shut-off means having a plunger connected to said lever and moving said lever away from said poppet valve when said automatic shut-off means is activated, a cavity provided within the nozzle body to house the automatic shut-off means, a latch ring mounting within the body cavity, a plurality of retention balls seated in an upper end of said plunger and disposed to engage said latch ring when biased outwardly, a latch pin disposed to seat in the upper end of said plunger and normally biasing said retention balls outwardly to engage said latch ring and to hold said nozzle poppet valve open for dispensing of fuel, said latch pin having a collar-like means including an annular sleeve-like collar mounted upon and extending upwardly from the latch pin integrally formed proximate its upper end thereof to limit the downward movement of the latch pin with respect to the plunger, and for further limit the downward movement of the diaphragm support with respect to the latch pin collar it surrounds, a diaphragm provided above said latch pin within the cavity, said diaphragm having a diaphragm support, said diaphragm support operatively associated with said latch pin, said diaphragm and said diaphragm support disposed to rise and fall with changes in pressure generated upon said diaphragm during fuel dispensing, said diaphragm support having a shoulder means formed surrounding its lower end thereof and surrounding said collar-like means of the latch pin to engage said collar-like means upon the latch pin during functioning of the automatic shut-off means, the collar-like means of said latch pin and the shoulder means of the diaphragm support defining a lost motion gap therebetween so that said latch pin can move downwardly for a distance independently of said diaphragm and said diaphragm support, and said diaphragm and diaphragm support can move upwardly for a distance, independent of said latch pin in response to changes in pressure generated upon said diaphragm, without effecting premature shut-off from said nozzle during fuel dispensing.

* * * * *